US005868546A

United States Patent [19]

Hahne et al.

[11] Patent Number: 5,868,546

[45] Date of Patent: Feb. 9, 1999

[54] DEVICE FOR FORMING A STACK ON A TRANSPORT TABLE

[75] Inventors: Ernst Hahne, Allschwil, Switzerland; Hermann Kunzig, Weil am Rhein, Germany

[73] Assignee: Eltexelektrostatik GmbH, Rhein, Germany

[21] Appl. No.: 809,549

[22] PCT Filed: Sep. 7, 1995

[86] PCT No.: PCT/EP95/03521

§ 371 Date: Mar. 21, 1997

§ 102(e) Date: Mar. 21, 1997

[87] PCT Pub. No.: WO96/09239

PCT Pub. Date: Mar. 28, 1996

[30] Foreign Application Priority Data

| | | | |
|---|---|---|---|
| Sep. 21, 1994 | [DE] | Germany | 44 33 583.9 |
| Sep. 30, 1994 | [DE] | Germany | 44 34 946.7 |
| Nov. 22, 1994 | [DE] | Germany | 44 41 431.5 |

[51] Int. Cl.[6] ..... B65H 31/34

[52] U.S. Cl. ..... 414/788; 414/788.9; 414/907

[58] Field of Search ..... 414/788, 788.9, 414/789.1; 923/907; 271/208

[56] References Cited

U.S. PATENT DOCUMENTS

| | | | |
|---|---|---|---|
| 3,834,290 | 9/1974 | Nelson | 414/789.1 |
| 4,765,791 | 8/1988 | Brandt et al. | 414/788 |
| 5,228,373 | 7/1993 | Welsch | 414/788 X |
| 5,437,534 | 8/1995 | Gales | 414/788.9 X |

FOREIGN PATENT DOCUMENTS

| | | | |
|---|---|---|---|
| 40 00 263 | 7/1991 | Germany | 414/788 |

*Primary Examiner*—Janice L. Krizek
*Attorney, Agent, or Firm*—Antonelli, Terry, Stout & Kraus, LLP

[57] ABSTRACT

The invention concerns a device for forming, on a conveyor table (7), a stack (6) of stacked objects, such as, for example, newspapers, magazines or the like, which stack is to be conveyed in the conveying direction. The stack is to be conveyed in the conveying direction. The stack is conveyed to a further, different workstation, for example, whilst being conveyed from a cross boom to a shrink-wrapping unit. The invention is characterized in that the stack has a blocking arrangement which comprises at least one charging electrode (11, 12) disposed in the conveying direction on both sides adjacent the stack and at least one contact roller (16) above the stack.

12 Claims, 2 Drawing Sheets

DEVICE FOR FORMING A STACK ON A TRANSPORT TABLE

BACKGROUND OF THE INVENTION

The invention relates to a device for forming a stack on a transport table.

A device of this kind is known of itself and serves for example for the stacking of newspapers, magazines, or the like by a so-called cross bar at a shrink station, especially for films.

Under the influence of the staples in the magazines as well as uneven inserts, such stacks of copies of magazines tend to slide or even fall over when they emerge from the cross bar and as they are being transported to the shrink station. Therefore, stacking robots cannot be used downstream from the cross bar since a stack that has slipped cannot be picked up.

SUMMARY OF THE INVENTION

The goal of the invention is to align the piled-up stack of objects more stably in a device according to the species.

The objects in the stack are charged, so opposite polarity already exists in the stack itself relative to the side areas of the stack that face away from one another and are electrostatically charged by the charging electrodes, in other words the side surfaces that are aligned perpendicularly to the transport direction. Since the paper stack has a higher dielectric constant than air, the electric field is concentrated in this area. In addition to this concentration, a field concentration takes place in the excess air trapped in the stack, so that the field force effect in the stack and the accumulated charge on the surface expels the air from the stack. This results in greater adhesion of the copies to one another, so that the stack is mechanically shaped into a block and consequently clamped together. It is assumed that the transport table is grounded, so that the electrical field of each side area is aligned in the form of an arc with the transport table.

According to the teaching of the invention, the stack is not only discharged with a polarity by means of the two laterally mounted charging electrodes, but additionally discharged on the top of the stack that is opposite the transport table by the preferably grounded contact roller, so that the block-forming effect can be even further improved.

BRIEF DESCRIPTION OF THE DRAWINGS

One preferred embodiment will now be described in greater detail with reference to the drawing.

DETAILED DESCRIPTION OF THE PREFERRED EMBODIMENTS

Figure 1:
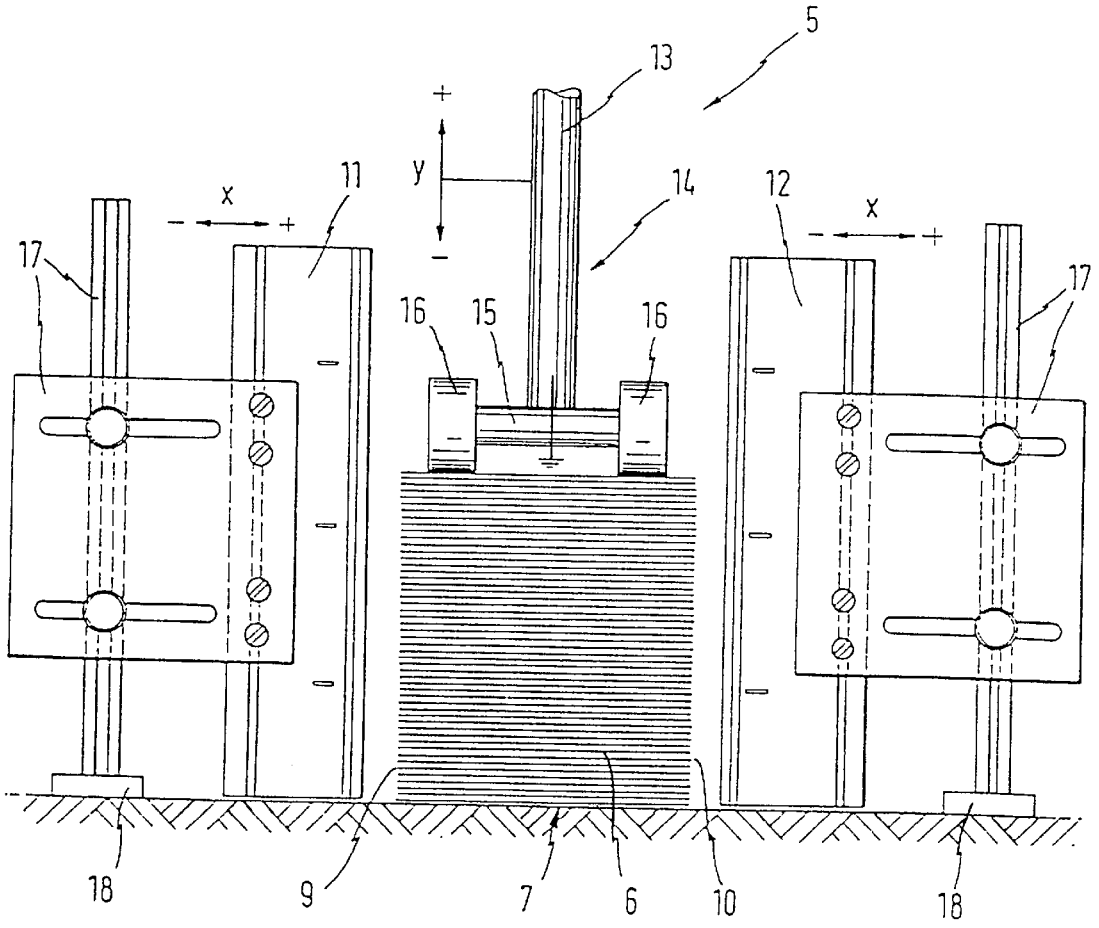
FIG. 1 is a schematic diagram of a device for forming a stack of magazines.

The device that is designated in FIG. 1 as a whole by 5 serves for shaping the stack represented as a whole by 6 into a block, said stack resting on a transport table that is designated as a whole by 7. This stack 6 is then advanced in transport direction 8 (FIG. 2) to the next work station, for example a shrink station, where the stack is wrapped in film and then welded, or shrink-wrapped with a shrink film.

To create an intrinsic mechanical rigidity of stack 6, the latter is shaped into a block by the block-forming device designated as a whole by 5. One charging electrode 11, 12 is provided on each of the two side surfaces 9 and 10 of stack 6 in the embodiment shown. These charging electrodes run perpendicularly to transport direction 8 and extend perpendicularly to transport table 7 up to the full height of stack 6 on its two sides 9 and 10 that are charged with negative polarity.

Figure 2:
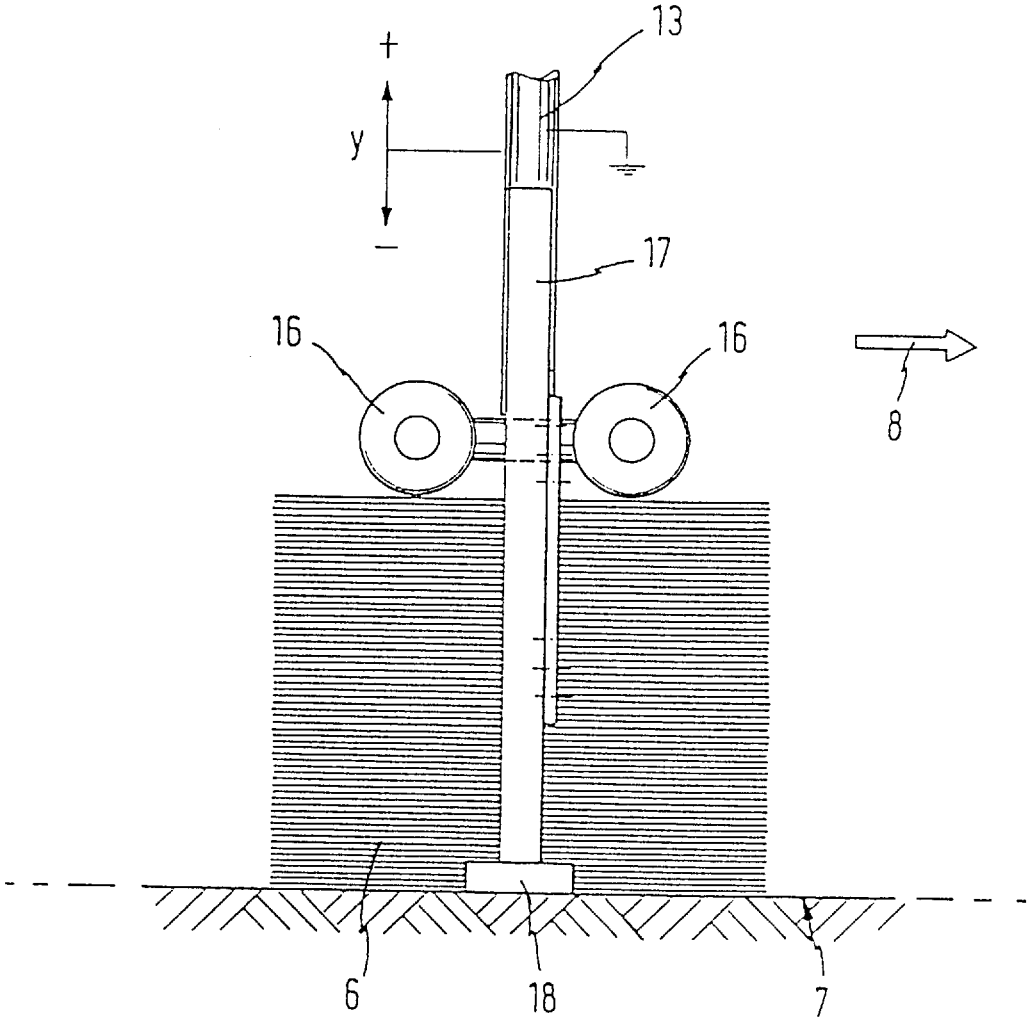
FIG. 2 shows the device according to FIG. 1 in a side view.

In addition, or a rod 13 that is movable vertically with respect to transport table 7 in direction Y a contact roll is provided, designated 14 as a whole, said roll being grounded in the embodiment shown, said roller having individual rollers 16 on both ends of a shaft 15 that runs transversely with respect to rod 13. As shown in FIG. 2, two shafts 15 can also be provided parallel to one another, at each of whose ends actual individual rollers 16 are provided. In addition, provision can be made such that not only do rollers 16 rest their intrinsic weight and that of rod 13 as well as shafts 15 on stack 6, but the force of rod 13 pressing from above in the direction of transport table 7 is also provided.

In addition, charging electrodes 11 and 12 can be movable in direction X at right angles to both transport direction 8 and to adjustment direction Y (FIG. 1). Holder 17 for the charging electrodes 11, 12 can also rest on feet 18 that are designed as magnetic feet.

We claim:

1. Device for forming a stack to be transported further on a transport table in a transport direction, said stack being composed of stacked objects, for example stacked newspapers, magazines, or the like, with said stack being transported further to another workstation for example during further transport from a cross bar to a shrink tunnel, characterized in that a block-forming device is provided for forming the stack, provided at a block forming location on said transport table, into a block, said block forming device having charging electrodes having the same polarity located on both sides of said stack with respect to the transport direction and next to the stack, and at least one grounded contact roller provided above the stack.

2. Device according to claim 1, characterized in that the transport table is grounded.

3. Device according to claim 1, characterized in that said at least one grounded contact roller is adjustable heightwise.

4. Device according to claim 1, characterized in that said at least one grounded contact roller is adjustable heightwise by a light barrier or a proximity switch.

5. Device according to claim 1, characterized in that at least one of said charging electrodes extends essentially parallel to the transport direction.

6. Device according to claim 5, characterized in that at least one of said charging electrodes extends transversely with respect to the transport direction.

7. Device according to claim 1, characterized in that said at least one grounded contact roller is held on the stack by its own weight.

8. Device according to claim 7, characterized in that said at least one grounded contact roller can additionally be pressed down in the direction of the stack.

9. Device according to claim 1, characterized in that the blocking-forming device rests on small feet.

10. Device according to claim 9, characterized in that said small feet are magnetic feet.

11. Device according to claim 1, characterized in that said charging electrodes extend perpendicularly from said transport table to the full height of the stack.

12. Device according to claim 11, wherein said charging electrodes are adjustable in a direction perpendicular to the transport direction.

* * * * *